US005687970A

United States Patent [19]

Clark

[11] Patent Number: 5,687,970

[45] Date of Patent: Nov. 18, 1997

[54] BOARD GAME DEVICE

[76] Inventor: William H. Clark, 5180 Kingsford Dr., Trotwood, Ohio 45426

[21] Appl. No.: 678,466

[22] Filed: Jul. 3, 1996

[51] Int. Cl.[6] ..... A63F 3/00

[52] U.S. Cl. ..... 273/264; 273/153 S; 273/281

[58] Field of Search ..... 273/236, 258, 273/260, 264, 271, 281, 282.1, 287, 153 S, 288

[56] References Cited

U.S. PATENT DOCUMENTS

| | | | |
|---|---|---|---|
| 163,601 | 2/1875 | Morgan . | |
| 1,085,941 | 2/1914 | Russell . | |
| 3,130,972 | 4/1964 | Schwarzlander | 273/131 |
| 3,727,916 | 4/1973 | Miller | 273/153 S |
| 4,452,454 | 6/1984 | Greene | 273/153 S |
| 4,470,601 | 9/1984 | Finn | 273/153 S |
| 4,708,348 | 11/1987 | Zaruba et al. | 273/246 |
| 4,886,278 | 12/1989 | Salter et al. | 273/242 |
| 5,427,379 | 6/1995 | Lee | 273/281 |
| 5,497,997 | 3/1996 | Nikas et al. | 273/281 |

*Primary Examiner*—William M. Pierce

[57] ABSTRACT

A gameboard includes a plurality of top-slotted, intersecting channels to define a grid of tracks for movement of playing pieces along and between the tracks. Each of the playing pieces includes a head projecting from the channel and a base within the channel. The head and base are interconnected by a neck having a collar so as to expand its cross section over a portion of its length. The neck passes through the slot to allow free movement of the piece along the tracks and inhibit removal of the piece from the plane of the gameboard. The collar is seated within the track intersections to restrict movement of the piece out of the intersections.

7 Claims, 3 Drawing Sheets

BOARD GAME DEVICE

BACKGROUND

1. Field of Invention

This invention relates to board games, and more particularly to board games having a grid of tracks and movably attached pieces.

2. Discussion of Prior Art

Over the years many game devices have been constructed which include a gameboard having a grid of top-slotted channels for the movement of playing pieces thereon and the capture of the playing pieces against removal from the board, for example in U.S. Pat. No. 5,427,379 to Lee (1995), U.S. Pat. No. 4,470,601 to Finn (1984), U.S. Pat. No. 4,452,454 to Greene (1984), U.S. Pat. No. 3,727,916 to Miller (1973), U.S. Pat. No. 3,130,972 to Schwarzlander (1964), and U.S. Pat. No. 1,085,941 to Russell (1914). Devices of this type have been constructed for the playing of chess and checkers, as well as for the playing of other games wherein movement of the playing pieces is restricted in accordance with the game itself. Several methods have been disclosed for making such devices suitable for play during travel by providing stabilization of the playing pieces at their playing positions on the board, while allowing free movement of the playing pieces along channels between playing positions, but all suffer from a number of disadvantages.

U.S. Pat. No. 5,427,379 to Lee (1995) discloses a spring biasing method which provides continuous stabilization of the playing pieces. The spring biasing arrangement is expensive to construct and requires a constant downward pressure on the playing piece as it is moved along a channel during play.

U.S. Pat. No. 3,737,916 to Miller (1973) discloses a game board in which spherical or polyhedron shaped pieces are captured within top-slotted, intersecting, cylindrical canals. Shallow concavities are placed at the base of canal intersections to provide stabilization of the playing pieces. Since the pieces must communicate with the board surface through the slots to allow the pieces to be pushed or rolled along the canals, the allowable depth of the shallow concavities is limited, and the pieces will roll out of the concavities when the board is tilted, thus limiting the utility of the device for play during travel.

SUMMARY OF THE INVENTION

The present invention provides a gameboard including a plurality of top-slotted, intersecting channels to define a grid of tracks for movement of playing pieces along and between the tracks.

Each of the playing pieces includes a head projecting from the channel and a base within the channel. The head and neck are interconnected by a neck having a collar so as to expand its cross section over a portion of its length. The neck passes through the slot to allow free movement of the piece along the tracks and inhibit removal of the piece from the plane of the gameboard. The collar is seated within track intersections to inhibit lateral movement of the piece out of the intersections. Each collar includes a boss so as to expand its cross section over a portion of its length to restrict vertical movement of the piece in the intersection.

Movement of playing pieces is similarly restricted at playing positions defined by holes superimposed on the slots.

Accordingly, several objects and advantages of the present invention are:

(a) to provide a new and improved board game device in which the above disadvantages are obviated or mitigated, (b) to provide a board game device having playing pieces which are captured in a grid of channels against removal from the gameboard and which are prevented from being jarred or jostled out of their playing positions by the effect of motion encountered during travel, (c) to provide a board game device having playing pieces which are prevented from sliding out of their playing positions when the gameboard is tilted up to ninety degrees from the horizontal plane.

(d) to provide a board game device having playing pieces which are freely movable along channels without the requirement that a biasing force be continually countered during such movement, and (e) to provide a board game device having playing pieces which may be fixed in their playing positions, at the option and control of the players, to preserve the disposition of the playing pieces on the gameboard during game interruptions.

Still further objects and advantages will become apparent from a consideration of the ensuing description and drawings.

REFERENCE NUMERALS IN DRAWINGS

Figure 1:
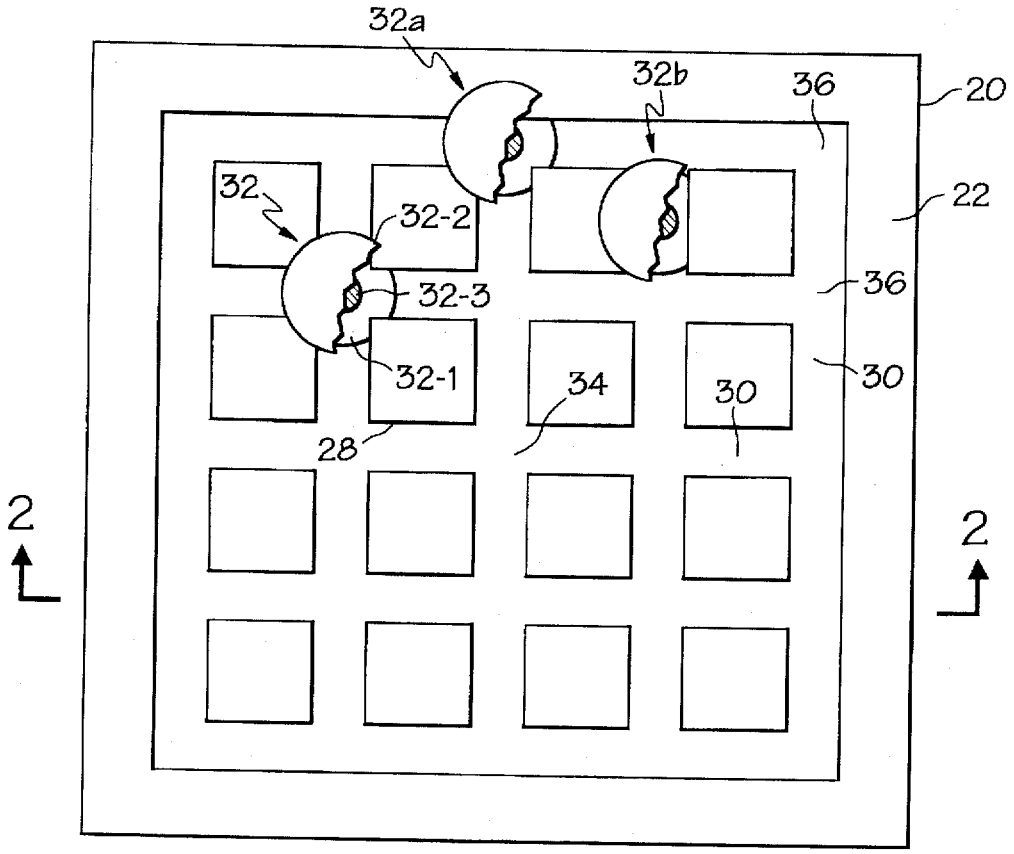
FIG. 1 PRIOR ART
FIG. 1 is a plan view of a game device, including a gameboard with playing pieces disposed thereon, showing prior art embodied in the device.

20 gameboard
22 gameboard surface
24 recessed channel
26 channel wall
28 channel flange
30 channel slot
32 playing piece—prior art
34 slot intersection
36 slot end intersection
38 gameboard—preferred embodiment
40 playing piece—preferred embodiment
42 hole

44 gameboard—second embodiment
46 playing piece—second embodiment
48 intersection boundary
50 slot end boundary
52 slot end Location of playing pieces on gameboards are donated by letter subscripts, and playing piece elements are denoted by numeric sub-references:

| | FIGS. 1 to 4 | FIGS. 5 to 8 | FIGS. 9 to 12 |
|---|---|---|---|
| playing piece | 32 | 40 | 46 |
| locations | 32, 32a, 32b | 40, 40a, 40b | 46, 46a, 46b |
| base | 32-1 | 40-1 | 46-1 |
| head | 32-2 | 40-2 | 46-2 |
| neck | 32-3 | 40-3 | 46-3 |
| collar | | 40-4 | 46-4 |
| boss | | | 46-5 |

DESCRIPTION OF THE PREFERRED EMBODIMENTS

Static description of each embodiment is followed by description of the operation of the parts covered in the static description.

DETAILED DESCRIPTION OF THE INVENTION

Prior art embodied in the game device is shown in FIGS. 1 to 4. A gameboard 20 is formed with a flat playing surface 22 and a plurality of recessed channels 24, best seen in FIG. 2. Each channel 24 is formed with opposing parallel walls 26, each of which terminates in a pair of inwardly directed flanges 28 which form a narrowed slot 30 communicating with surface 22. Sets of parallel channels 24 are orthogonally disposed and, together with slots 30, form a grid of tracks for the movement of playing pieces 32 over surface 22, best seen in FIG. 1.

Figure 3:
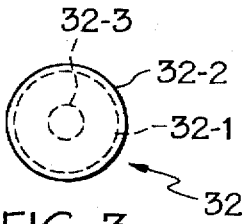
FIG. 3 PRIOR ART
FIG. 3 is a top view of a playing piece suitable for use with the gameboard of FIG. 1.
Figure 4:
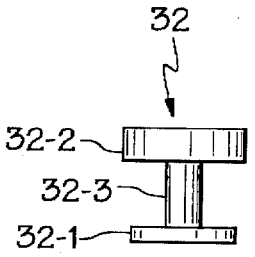
FIG. 4 PRIOR ART
FIG. 4 is a side view of the playing piece of FIG. 3.

Each piece 32 is similar in size and shape and includes a base 32-1 and a head 32-2, which are interconnected by a neck 32-3, best seen in FIGS. 3 and 4. The base is formed with a circular cross section and is dimensioned to slide along the channels, while being retained within the channels by the flanges. The head may be of any size and shape having a cross section sufficiently small to avoid interference of adjacent pieces when moved along adjacent parallel channels. The neck is dimensioned to pass through the slots to allow movement of the piece along the channels.

Figure 2:
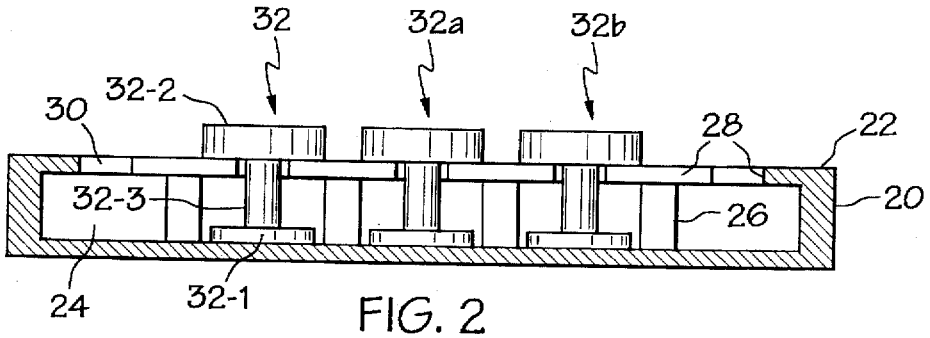
FIG. 2 PRIOR ART
FIG. 2 is a sectional view along the line 2—2 of FIG. 1.

The pieces are easily moved along the channels, as best seen by the placement of piece **32*b* in FIGS. 1 and 2. When the pieces are positioned at slot intersections, as best seen by the placement of pieces 32 and 32*a* in FIGS. 1 and 2**, movement of the pieces is restricted only by frictional forces between the pieces and the gameboard.

The preferred embodiment includes a gameboard 38 with surface 22, channels 24, walls 26, flanges 28, and slots 30, all of which are formed and arranged as previously described and seen in FIGS. 1 and 2.

A plurality of playing pieces 40 are provided. Each piece 40 includes a base 40-1, a head 40-2, and a neck 40-3 which are similar in size, shape and function to base 32-1, head 32-2 and neck 32-2, respectively, as seen in FIGS. 1 to 4. Piece 40 further includes a collar 40-4 so as to expand the cross section of neck 40-3 over the upper portion of its length. Collar 40-4 is dimensioned such that its diameter is greater than the width of slot 30 and less than the diameter of the largest cylindrical surface which can be inscribed within an intersection 34, thereby allowing collar 40-4 to be freely seated within the intersection. In other embodiments the diameter of collar 40-4 may be equal to the diameter of the largest cylindrical surface which can be inscribed within the intersection, thereby providing frictional seating of collar 40-4. A cylindrical hole 42, having an axis perpendicular to surface 22, is superimposed on each slot end intersection 36. The diameter of hole 42 is greater than the diameter of collar 40-4 and smaller than the diameter of base 40. In other embodiments the diameter of hole 42 may be equal to the diameter of collar 40-4. The length of collar 40-4 and the thickness of flanges 28 are dimensioned during construction such that a portion of each collar will remain within its respective intersection as the pieces are displaced vertically by predetermined levels of motion associated with travel.

Figure 5:
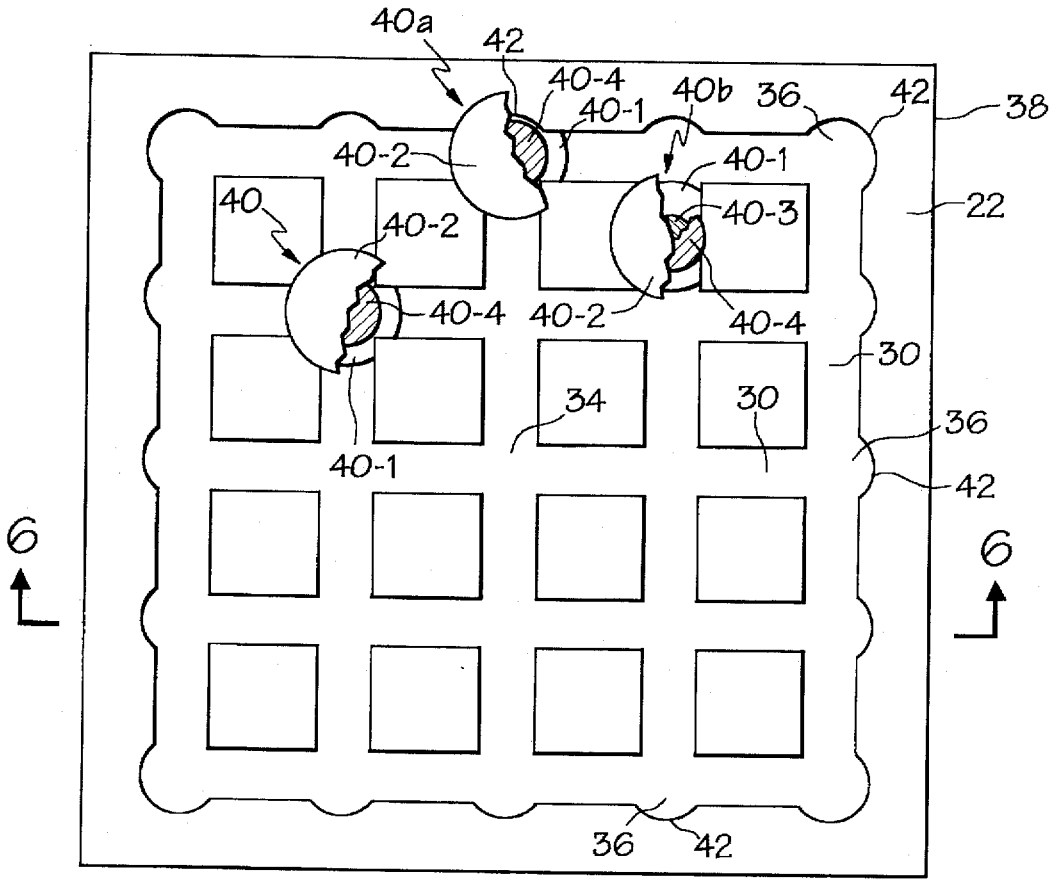
FIG. 5 is a plan view of a game device, including a gameboard with playing pieces disposed thereon, constructed and arranged in accordance with the present invention.
Figure 6:
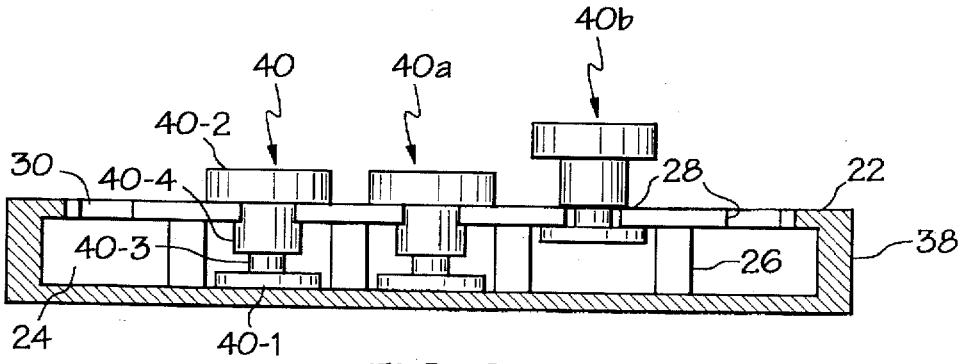
FIG. 6 is a sectional view along the line 6—6 of FIG. 5.
Figure 7:
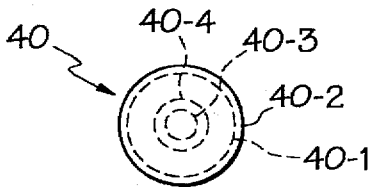
FIG. 7 is a top view of a playing piece constructed in accordance with the present invention.
Figure 8:
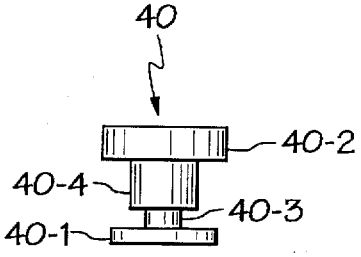
FIG. 8 is a side view of the playing piece of FIG. 7.

A piece may be moved along a channel when it is raised vertically by a player a sufficient distance to allow neck 40-3 to pass through slot 30, as best seen by the arrangement of piece **42*b* in FIGS. 5 and 6. When a piece is moved laterally into an intersection 34 or 36 and then released, the piece will drop into the intersection, and collar 40-4 will inhibit lateral movement of the piece out of the intersection, as best seen by the arrangement of pieces 40 and 40*a* in FIGS. 5 and 6**.

The edges of flanges 28, the surfaces of holes 42, and the cylindrical surface of collar 40-4 are parallel, and are perpendicular to surface 22, best seen in FIG. 6. The gameboard may therefore be tilted up to ninety degrees from the horizontal plane before the force of gravity will cause pieces to slide out of their seated positions within the intersections.

A second embodiment of the game device includes a board 44 with surface 22, channels 24, walls 26, flanges 28 and slots 30, all of which are formed as previously described and seen in FIGS. 1, 2, 5, and 6. Each of the slots terminates at slot ends 52, best seen in FIG. 9.

A plurality of playing pieces 46 are provided. Each of the playing pieces 46 includes a base 46-1, a head 46-2, a neck 46-3, and a collar 46-4 which are similar in size, shape and function to base 40-1, head 40-2, neck 40-3 and collar 40-4, respectively, as previously described and seen in FIGS. 5 to 8. Piece 46 further includes a boss 46-5, comprising a torus superimposed on collar 46-4 so as to increase its diameter over a portion of its length. Boss 46-5 is formed with a diameter of sufficient size to provide frictional contact with the lateral boundary 48 of slot intersections 34 and the lateral boundary 50 of slot ends 52, best seen by the placement of pieces 46 and **46*a* in FIG. 9. Boundary 48 is formed by a cylindrical hole superimposed on slot intersection 34. Boundary 50 is similarly formed by a cylindrical hole superimposed on slot end 52. It should be understood that pieces 46 are also suitable for use with gameboard 38, and that pieces 40 are also suitable for use with gameboard 44**.

Figure 9:
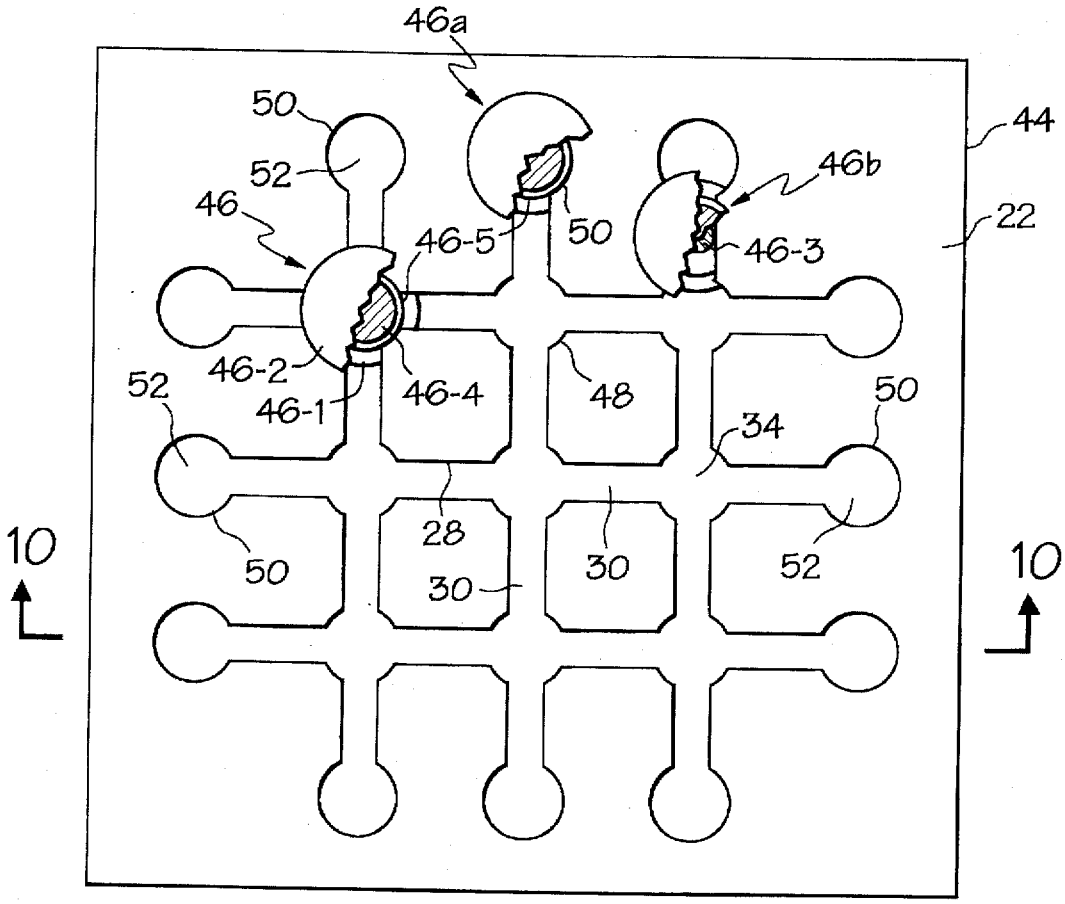
FIG. 9 is a plan view of a game device including a second embodiment of a gameboard with playing pieces disposed thereon constructed in accordance with the present invention.
Figure 10:
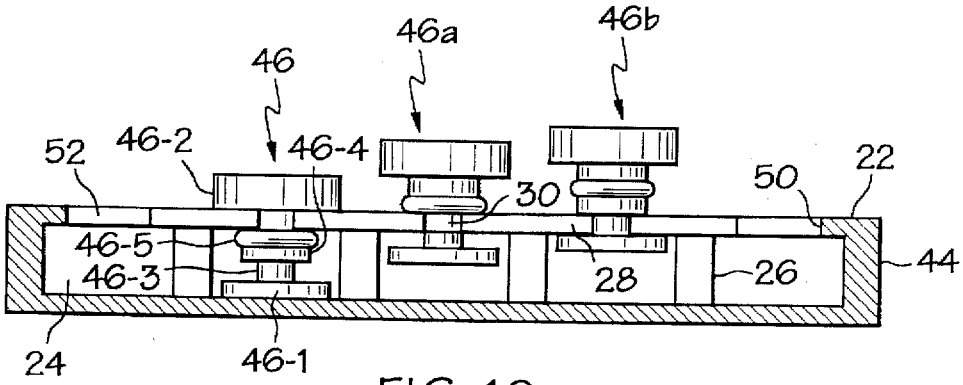
FIG. 10 is a sectional view along the line 10—10 of FIG. 9.
Figure 11:
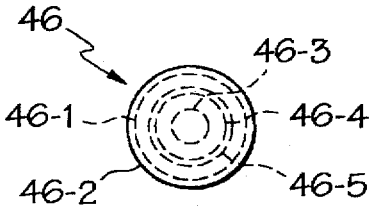
FIG. 11 is a top view of a second embodiment of a playing piece constructed in accordance with the present invention.
Figure 12:
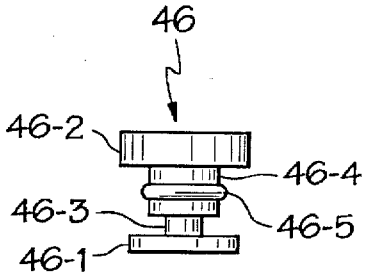
FIG. 12 is a side view of the playing piece of FIG. 11.

Pieces 46 may be moved along channels 24 when raised vertically by a player a sufficient distance to allow neck 46-3 to pass through slot 30, as best seen by the placement of piece **46*b* in FIGS. 9 and 10. When a piece is moved laterally into a slot end 52 and then released, the piece will drop into a seated position wherein the lower portion of collar 46-4 will inhibit lateral movement of the piece out of the slot end position, as best seen by the placement of piece 46*a* in FIGS. 9 and 10. It should be understood that the piece will be similarly seated, and its movement similarly inhibited, when it is moved laterally into a slot intersection 34 and then released. The piece may be fully seated in an intersection 34 by application of force to overcome the frictional force imposed on base 46-5 by boundary 48, as best seen by the placement of piece 46 in FIGS. 9 and 10. The upper portion of collar 46-4 will then inhibit lateral movement of the piece out of the intersection, and vertical movement of the piece is restricted by boss 46-5 to retain the piece in its position in the event the gameboard is inverted during game interruptions. It should be understood that the pieces may be similarly seated, and their movement similarly inhibited and restricted, at slot ends 52**.

Accordingly, the reader will see that the game device permits the simple and inexpensive construction of a variety of gameboard and playing component configurations suitable for play during travel, wherein the playing components are captured against removal from the plane of the gameboard, are stabilized in playing positions, and are easily movable between playing positions. Furthermore, the game device has additional advantages in that a) it provides the production of a gameboard from a single piece of wood, plastic, or other suitable material, b) it provides the production of playing pieces which are each formed from a single piece of wood, plastic, or other suitable material, c) it provides the production of game pieces having heads of any desired size and shape that do not inhibit movement of pieces along adjacent parallel tracks, d) it provides retention of playing pieces in predetermined playing positions by the force of gravity alone as the device is subjected to accelerations associated with a predetermined level of turbulence and/or tilting of the board surface up to ninety degrees from the horizontal plane, thereby making the device useful for play during travel, and e) it provides preservation of the disposition of the playing pieces during game interruptions.

Although the description above contains many specificity's, they should not be construed as limiting the scope of the invention but merely providing illustrations of some of the presently preferred embodiments of the invention. For example, the grid of tracks may include combinations of the intersection and slot end configurations described in the above embodiments; the sets of intersecting tracks may be more than two in number; tracks may intersect at acute angles, rather than being orthogonally disposed; the playing piece neck cross section may have other shapes, such as polyhedron; the playing piece bosses may have other toroidal shapes; etc.

Thus the scope of the invention should be determined by the appended claims and their legal equivalents, rather than by the examples given.

I claim:

1. A game device comprising:

a gameboard having a surface that is machined to provide a grid of recessed channels for movement of a plurality of playing pieces along and between said channels;

each of said channels having a pair of inwardly directed flanges to define a narrowed slot in the surface of said gameboard;

each of said pieces having a head projecting above said surface and a base located within said channel;

said head and base being interconnected by a neck passing through said slot to allow free movement of said piece along said channels and inhibit removal of said piece from the surface of said gameboard;

said slots forming a grid of intersecting tracks on said surface;

each intersection of said slots defining a diameter of the largest cylindrical surface which can be inscribed within said intersection;

said diameter being greater than a width of said slot and smaller than a diameter of said base; and said neck having a collar so as to expand a diameter of said neck over a portion of a length to allow seating of said collar within said intersection to inhibit lateral movement of said piece out of said intersection.

2. A game device according to claim 1, wherein said collar is cylindrical in shape.

3. A game device according to claim 1, wherein said collar has a boss so as to expand its cross section over a portion of its length.

4. A game device according to claim 3, wherein said boss is torroidal in shape.

5. A game device according to claim 1, wherein said slots have a pair of parallel walls perpendicular to said surface.

6. A game device according to claim 1, wherein a plurality of holes in said surface are superimposed on said slots to allow seating of said collar in said holes.

7. A game device according to claim 6, wherein said holes are cylindrical in shape.

* * * * *